US007309031B2

(12) United States Patent
Goto et al.

(10) Patent No.: US 7,309,031 B2
(45) Date of Patent: Dec. 18, 2007

(54) FUEL INJECTION VALVE

(75) Inventors: Moriyasu Goto, Nishio (JP); Shigeiku Enomoto, Nishio (JP); Kazuhiro Omae, Toyota (JP)

(73) Assignees: Nippon Soken, Inc., Nishio (JP); Toyota Jidosha Kabushiki Kaisha, Toyota (JP)

( * ) Notice: Subject to any disclaimer, the term of this patent is extended or adjusted under 35 U.S.C. 154(b) by 1 day.

(21) Appl. No.: 10/941,001

(22) Filed: Sep. 15, 2004

(65) Prior Publication Data

US 2005/0072865 A1 Apr. 7, 2005

(30) Foreign Application Priority Data

Oct. 1, 2003 (JP) ..... 2003-343576

(51) Int. Cl.
*B05B 1/30* (2006.01)
*F05M 51/00* (2006.01)

(52) U.S. Cl. ..... 239/585.1; 239/533.2; 239/533.3; 239/533.9; 239/585.5; 251/129.02

(58) Field of Classification Search .. 239/585.1–585.5, 239/533.2, 533, 533.9, 533.3; 251/129.01, 251/129.02

See application file for complete search history.

(56) References Cited

U.S. PATENT DOCUMENTS

| | | | | |
|---|---|---|---|---|
| 4,749,892 A | 6/1988 | Mesenich | | |
| 4,946,107 A * | 8/1990 | Hunt | ..... | 239/585.4 |
| 5,464,156 A | 11/1995 | Ricco et al. | | |
| 6,367,769 B1 | 4/2002 | Reiter | | |
| 6,679,440 B2 * | 1/2004 | Igashira et al. | ..... | 239/533.3 |
| 6,772,965 B2 * | 8/2004 | Yildirim et al. | ..... | 239/533.3 |
| 2002/0179742 A1 | 12/2002 | Yildirim et al. | | |

FOREIGN PATENT DOCUMENTS

| | | | | |
|---|---|---|---|---|
| DE | 198 49 210 A1 | 4/2000 | | |
| DE | 199 46 766 A1 | 4/2001 | | |
| EP | 1 088 985 B1 | 3/2006 | | |
| JP | A 59-205084 | 11/1984 | | |
| JP | U 63-83456 | 6/1988 | | |
| JP | B2-2601977 | 1/1997 | | |
| JP | A-2000-257534 | 9/2000 | | |
| JP | A 2002-339831 | 11/2002 | | |
| JP | A 2003-293910 | 10/2003 | | |
| WO | WO 02/06664 A1 * | 1/2002 | ..... | 239/533.3 |

* cited by examiner

*Primary Examiner*—Kevin Shaver
*Assistant Examiner*—Jason Boeckmann
(74) *Attorney, Agent, or Firm*—Oliff & Berridge PLC

(57) ABSTRACT

A fuel injection valve includes a fuel injection port, a needle for cutting the fuel flow into the fuel injection port and a needle mover for moving the needle away from the fuel injection port and allowing the fuel to flow into the fuel injection port. When the needle is moved away from the fuel injection port by the needle mover, the force is applied by a force applicator to the needle away from the fuel injection port only during the period when the needle is moved away from the fuel injection port to less than a predetermined degree.

3 Claims, 13 Drawing Sheets

FUEL INJECTION VALVE

BACKGROUND OF THE INVENTION

1. Field of the Invention

The present invention relates to a fuel injection valve.

2. Description of the Related Art

Japanese Unexamined Patent Publication No. 2000-257534 discloses a fuel injection valve for injecting fuel into the combustion chamber of the internal combustion engine. This fuel injection valve comprises a fuel injection port (referred to, in the publication cited above, as "the fuel injection holes" designated by reference numeral 8) and a member for closing the fuel injection port (in the cited publication, corresponds to a movable portion 4A including a plunger 4, a rod 5 and a valve body 6, and hereinafter referred to as "the movable portion" as in the cited publication). In this fuel injection valve, the movable portion is subjected to the force generated by the fuel pressure (hereinafter referred to as "the valve opening force due to the fuel pressure") acting on the movable portion in the direction to open the fuel injection port (hereinafter referred to as "the valve opening direction"), the force generated by the fuel pressure (hereinafter referred to as "the valve closing force due to the fuel pressure") acting on the movable portion in the direction to close the fuel injection port (hereinafter referred to as "the valve closing direction") and the force generated by a spring (hereinafter referred to as "the valve closing force due to the spring") acting on the movable portion in the valve closing direction. Also, this fuel injection valve includes a means (hereinafter referred to as "the electromagnetic means") for electromagnetically generating the force acting on the movable portion in the valve opening direction.

In the fuel injection valve disclosed in the publication cited above, as the sum of the two valve closing forces (i.e. the valve closing forces due to the fuel pressure and the spring) is larger than the valve opening force due to the fuel pressure, the fuel injection port is closed by the movable portion in the case where the force from the electromagnetic means (hereinafter referred to as "the valve opening force due to the electromagnetic means") is not generated. In view of the fact that the total valve opening force due to the electromagnetic means and the fuel pressure is larger than the total valve closing force due to the fuel pressure and the spring, on the other hand, the movable portion is moved away from the fuel injection port thereby to open the fuel injection port and inject the fuel from the fuel injection port when the force is generated by the electromagnetic means.

In the fuel injection valve disclosed in the cited publication, when the force is generated by the electromagnetic means and the movable portion is moved away from the fuel injection port, the valve opening force due to the fuel pressure increases with the distance covered by the movable portion. When the movable portion is moved to the point farthest from the fuel injection port, the valve opening force due to the fuel pressure assumes a maximum value substantially equal to the valve closing force due to the fuel pressure. In the case where the valve opening force due to the electromagnetic means ceases to be generated under this condition, the movable portion closes the fuel injection port. As the valve opening force due to the fuel pressure is substantially equal to the valve closing force due to the fuel pressure under this condition, as described above, the overall valve closing force cannot be increased by controlling the fuel pressure. In order to cause the movable portion to close the fuel injection port satisfactorily, therefore, the valve closing force due to the spring is required to be correspondingly large.

The valve opening force due to the fuel pressure is small when the fuel injection port is closed by the movable portion. In order to cause the movable portion to move satisfactorily in the case where the valve closing force due to the spring is excessively large, therefore, it is necessary to use an electromagnetic means of high performance (i.e. an electromagnetic means capable of generating a larger valve opening force). Generally, the electromagnetic means of high performance is large in size. In the case where the electromagnetic means of high performance is required, therefore, the use of an electromagnetic means large in size is unavoidable, thereby leading to a large fuel injection valve. In the case where the fuel injection valve is mounted on the internal combustion engine, for example, the mountability of the fuel injection valve on the internal combustion engine is deteriorated. Also, a bulky electromagnetic means is generally low in responsiveness.

Accordingly, the object of this invention is to provide a fuel injection valve requiring no large electromagnetic means (generally, no electromagnetic means of high performance).

SUMMARY OF THE INVENTION

In order to solve the problem described above, according to a first aspect of the invention, there is provided a fuel injection valve comprising a fuel injection port, a needle for cutting off the fuel flowing into the fuel injection port, a needle moving means for moving the needle away from the fuel injection port and allowing the fuel to flow into the fuel injection port, and a force application means for applying the force to the needle in the direction away from the fuel injection port only during the period when the degree to which the needle has moved away from the fuel injection port is smaller than a predetermined degree while the needle is moved away from the fuel injection port by the needle moving means.

According to a second aspect of the invention, there is provided a fuel injection valve in the first aspect, wherein the force application means includes an elastic member for generating the force to move the needle away from the fuel injection port, and the force generated by the elastic member is applied to the needle until the needle moves away from the fuel injection valve to the aforementioned predetermined degree from the state in which the fuel flow into the fuel injection port is cut off by the needle, and the application of the force generated by the elastic member to the needle is cut off when the needle is moved at least to the predetermined degree away from the fuel injection port.

According to a third aspect of the invention, there is provided a fuel injection valve in the first aspect, wherein the force application means includes a pressure receiving member for receiving the force from the fuel in the direction away from the fuel injection port, and the force received by the pressure receiving member from the fuel is applied to the needle until the needle moves away from the fuel injection valve to the aforementioned predetermined degree from the state in which the fuel flow into the fuel injection port is cut off by the needle, and the application of the force received by the pressure receiving member from the fuel to the needle is cut off when the needle is moved at least to the predetermined degree away from the fuel injection port.

According to a fourth aspect of the invention, there is provided a fuel injection valve in any one of the first to third aspects, further comprising a housing for accommodating the needle, wherein the needle, while cutting off the fuel flow into the fuel injection port, is in contact with the inner wall surface of the housing, and when the needle comes away from the inner wall surface of the housing, the fuel is allowed to flow into the fuel injection port, when the needle comes off from the inner wall surface of the housing, the fuel circumvents the needle and flows to the neighborhood of the forward end of the needle through the space between the needle and the inner wall surface of the housing, and the aforementioned predetermined degree corresponds to a point where the fuel flowing between the needle and the inner wall surface of the housing begins to be restricted when the needle comes off from the inner wall surface of the housing. The housing corresponds to the nozzle in the embodiments of the invention described later.

Generally, the needle of the fuel injection valve, when moved in the direction away from the fuel injection port, is subjected to the force in the direction away from the fuel injection port (valve opening force due to the fuel pressure) by the pressure of the fuel flowing into the forward end of the needle. The valve opening force due to the fuel pressure tends to increase with the degree to which the needles moves away from the fuel injection port. The valve opening force due to the fuel pressure, therefore, assumes a maximum value when the needle is separated farthest from the fuel injection port. In order to move the needle toward the fuel injection port and cut off the fuel flow into the fuel injection port satisfactorily by the needle, therefore, a valve closing force commensurate with the valve opening force due to the fuel pressure (i.e. the force to move the needle toward the fuel injection port) is exerted on the needle. However, the valve opening force due to the fuel pressure is smaller, the smaller the degree to which the needle moves away from the fuel injection port. Especially, the valve opening force due to the fuel pressure assumes a minimum value when the needle cuts off the fuel flow into the fuel injection port. In order to move the needle in the direction away from the fuel injection port while the fuel flow into the fuel injection port is cut off, therefore, a comparatively large valve opening force must be applied to the needle. This force is applied by a needle moving means and for applying such a comparatively large valve opening force, the needle moving means is generally required to be high in performance (or large in size).

According to this invention, however, when the needle is moved in the direction away from the fuel injection port by the needle moving means, the force application means applies the force to the needle to move away from the fuel injection port during the period when the degree to which the needle is away from the fuel injection port is smaller than a predetermined degree. For this reason, the needle cutting off the fuel flow into the fuel injection port can be moved away from the fuel injection port with a smaller force by the needle moving means. In other words, according to the invention, a high-performance valve opening means (such as a large-sized valve opening means) is not required.

BRIEF DESCRIPTION OF THE DRAWINGS

The present invention may be more fully understood from the description of the preferred embodiments of the invention set forth below together with the accompanying drawings, in which.

DESCRIPTION OF THE PREFERRED EMBODIMENTS

Figure 1:
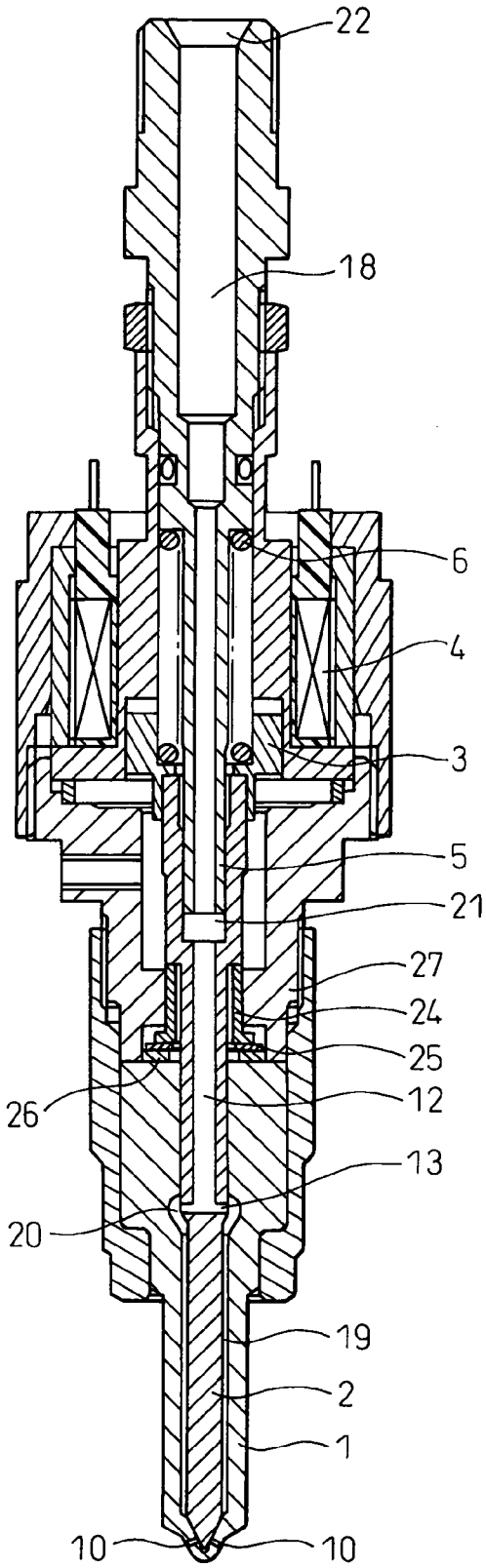
FIG. 1 is a longitudinal sectional view showing a fuel injection valve according to a first embodiment of the invention.

The best mode for embodying the invention will be explained below with reference to the drawings. FIG. 1 shows a fuel injection valve according to a first embodiment of the invention. In FIG. 1, reference numeral 1 designates a nozzle, numeral 2 a needle, numeral 3 an armature, numeral 4 a solenoid, numeral 5 a balance rod, and numeral 6 a coil spring.

Figure 2:
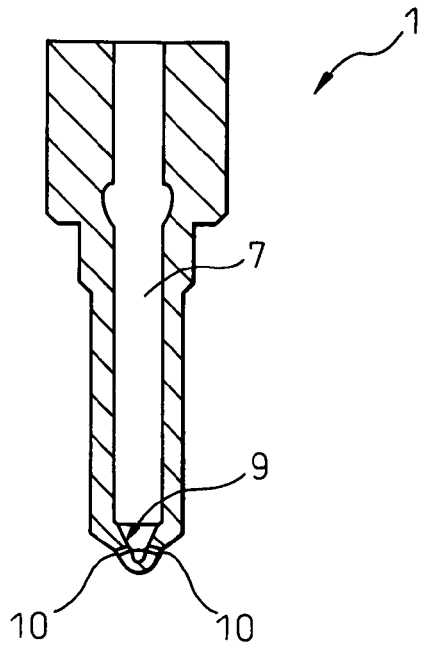
FIG. 2 is a longitudinal sectional view of a nozzle of the fuel injection valve shown in FIG. 1.

FIG. 2 shows the nozzle 1. As shown in FIG. 2, a space 7 is formed along the longitudinal axis of the fuel injection valve (hereinafter referred to simply as "the longitudinal axis") of the nozzle 1. This space 7 is narrowed (the lower side in the drawing is hereinafter referred to as "the forward end side", and the upper side as "the base end side") and the inner wall surface 9 for defining the space 7 assumes a conical shape at the forward end side of the nozzle 1. Also, fuel injection ports 10 are formed at the forward end of the nozzle 1. The fuel injection ports 10 communicate with the space 7.

Figure 3:
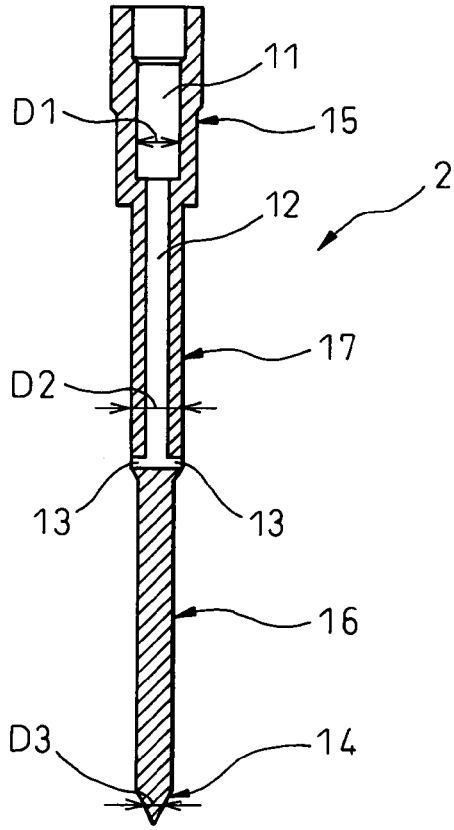
FIG. 3 is a longitudinal sectional view of a needle of the fuel injection valve shown in FIG. 1.

FIG. 3 shows the needle 2. Though not described in detail, the needle 2 cuts off or allows the fuel to flow into the fuel injection port 10. As shown in FIG. 3, a base end-side space 11 extending along the longitudinal axis and a forward end-side space 12 similarly extending along the longitudinal axis are formed in the needle 2. The spaces 11, 12 communicate with each other, and the diameter of the base end-side space 11 is larger than the diameter of the forward end-side space 12. Paths 13 extending in the direction perpendicular to the longitudinal axis are formed at the forward end side of the space 12 of the needle 2. The paths 13 communicate with the space 12. Also, the forward end of the needle 2 is narrowed and has a substantially conical outer wall surface 14. The base end-side portion 15, the forward end-side portion 16 and the portion 17 between them (hereinafter referred to as "the intermediate portion") of the needle 2 have different diameters. Specifically, the diameter of the base end-side portion 15 is largest, the diameter of the forward end-side portion 16 is smallest, and the diameter of the intermediate portion 17 assumes a value between these two diameters.

Figure 4:
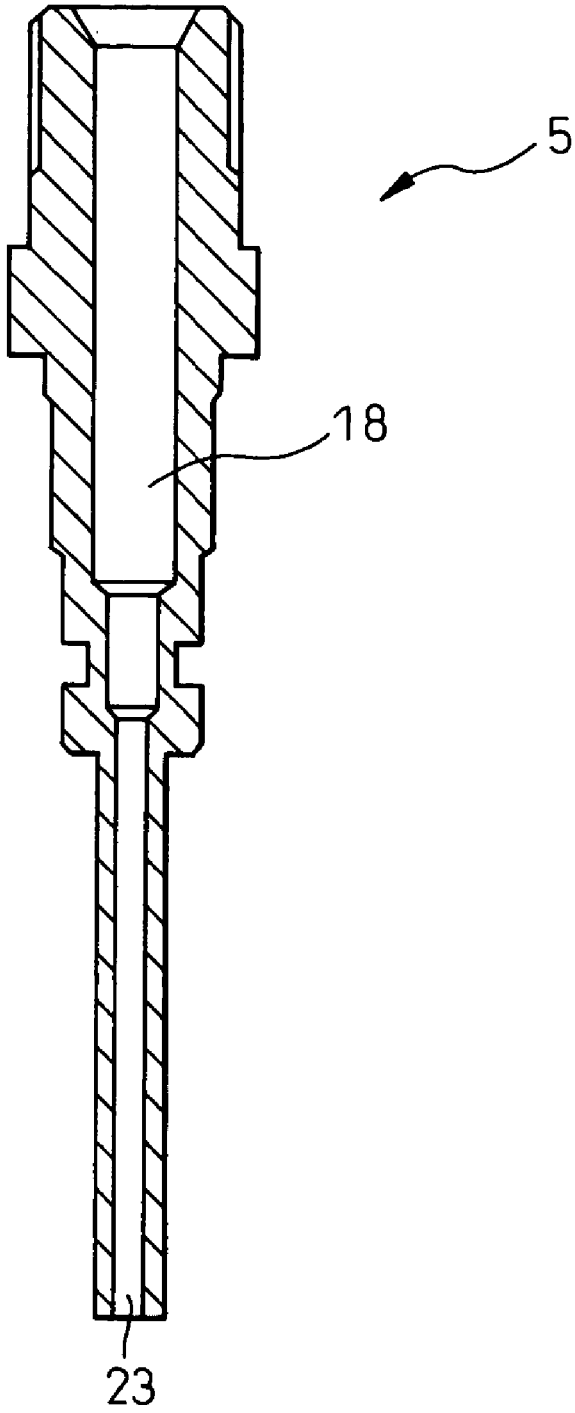
FIG. 4 is a diagram showing a balance rod of the fuel injection valve shown in FIG. 1.

FIG. 4 shows the balance rod 5. As shown in FIG. 4, a space 18 is formed in and through the balance rod 5 along the longitudinal axis.

As shown in FIG. 1, the portion of the needle 2 including the intermediate portion 17 and the forward end portion 16 is accommodated in the space 7 of the nozzle 1 (hereinafter referred to as "the nozzle space 7"). The needle 2 is adapted to slide with respect to the nozzle 1 along the longitudinal axis in the nozzle space 7. The diameter of the intermediate portion 17 of the needle 1 is substantially equal to the diameter of the nozzle space 7. Therefore, substantially no gap is formed between the outer wall surface of the intermediate portion 17 of the needle 2 and the wall surface defining the nozzle space 7 (hereinafter referred to simply as "the nozzle inner wall surface"). The diameter of the forward end portion 16 of the needle 2, on the other hand, is smaller than the diameter of the nozzle space 7. A gap 19 is formed, therefore, between the outer wall surface of the forward end portion 16 of the needle 2 and the nozzle inner wall surface. The base end-side portion of the gap 19 forms a comparatively large chamber (hereinafter referred to as "the nozzle chamber") 20. The paths 13 of the needle 2 are open to the nozzle chamber 20. The substantially conical outer wall surface 14 of the forward end portion of the needle 2 is adapted to come into contact with the conical inner wall surface 9 defining the forward end area of the nozzle space 7. In the description that follows, the substantially conical outer wall surface 14 of the needle 2 is hereinafter referred to as "the needle seat wall surface 14", the conical inner wall surface 9 of the nozzle 1 as "the nozzle seat wall surface 9", and the portion of the needle seat wall surface 14 in contact with the nozzle seat wall surface 9 (which surrounds the needle seat wall surface 14) as "the seat portion". While the needle seat wall surface 14 is in contact with the nozzle seat wall surface 9, the fuel flow into the fuel injection port 10 is cut off. Under this condition, no fuel is injected from the fuel injection valve. Once the needle seat wall surface 14 comes off from the nozzle seat wall surface 9, on the other hand, the fuel is allowed to flow into the fuel injection port 10. Under this condition, the fuel is injected from the fuel injection valve.

As shown in FIG. 1, the forward end portion of the balance rod 5 is accommodated in the base end-side space 11 of the needle 2. The needle 2 is slidable with respect to the balance rod 5. A chamber designated by reference numeral 21 (hereinafter referred to as "the pressure chamber") is formed between the balance rod 5 and the needle 2.

As shown in FIG. 1, the armature 3 is mounted at the base end of the needle 2. The solenoid 4 is arranged in proximity to the armature 3 and adapted to be supplied with power. The solenoid 4, when supplied with power, generates an electromagnetic force. This electromagnetic force attracts the armature 3 toward the base end. According to this embodiment, the needle 2 is moved in the direction away from the fuel injection port 10. In this way, the needle seat wall surface 14 comes off from the nozzle seat wall surface 9.

The coil spring 6 is arranged between the wall surface, which is formed on the balance rod 5 and faces the forward end side, and the wall surface, which is formed on the armature 3 and faces the base end side. The coil spring 6 urges the needle 2 in the direction toward the fuel injection port 10 at the forward end side (hereinafter referred to as "the valve closing direction").

Figure 5:
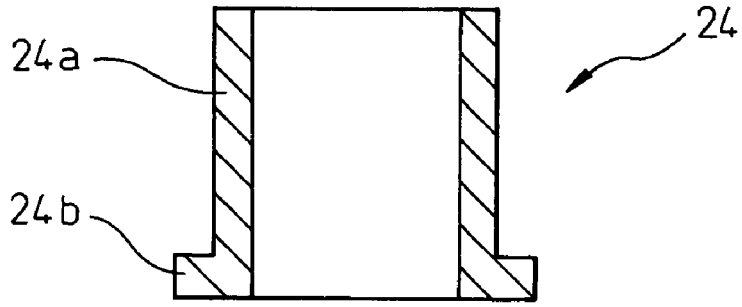
FIG. 5 is a longitudinal sectional view of a transmission member of the fuel injection valve shown in FIG. 1.
Figure 6:
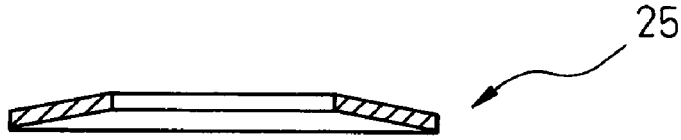
FIG. 6 is a longitudinal sectional view of an elastic member shown in FIG. 1.
Figure 7:
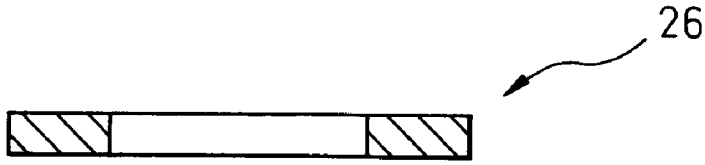
FIG. 7 is a longitudinal sectional view of an annular member shown in FIG. 1.

The fuel injection valve includes a tubular member 24, an elastic member 25 and an annular member 26. FIG. 5 shows the tubular member 24, FIG. 6 the elastic member 25 and FIG. 7 the annular member 26. The tubular member 24 is for transmitting the elastic force of the elastic member 25 to the needle 2 and is hereinafter referred to as "the transmission member". The annular member 26 is a part for adjusting the elastic force of the elastic member 25. As shown in FIG. 5, the transmission member 24 includes a tubular body **24*a*, and a flange portion 24*b* extending in the direction perpendicular to the center axis (longitudinal axis) of the body 24*a* from the lower outer wall surface of the body 24*a* in the direction away from the center axis of the body 24*a*. The transmission member 24 is arranged between the needle 2 and the body 27 of the fuel injection valve as viewed along the diameter in such a form as to accommodate the intermediate portion 17 of the needle 2. A gap is formed between the inner peripheral surface of the transmission member 24 and the outer peripheral surface of the intermediate portion 17 of the needle 2. On the other hand, no gap is formed between the outer peripheral surface of the transmission member 24 and the inner peripheral surface of the body 27 of the fuel injection valve. The transmission member 24, with the outer peripheral surface thereof in contact with the inner peripheral surface of the body 27 of the fuel injection valve, is slidable with respect to the body 27 of the fuel injection valve. Further, in the state shown in FIG. 1, a gap is formed between, as viewed along the longitudinal axis, the wall surface of the transmission member 24 facing the base end side (specifically, the wall surface of the flange portion 24 facing the base end side) and the wall surface 27*a* of the fuel injection valve body 27 facing the forward end side (see FIG. 9** for more detail).

The elastic member 25 according to this embodiment is an annular disk spring and may be an elastic member such as a wave spring. The elastic member 25 is arranged, as viewed diametrically, between the needle 2 and the fuel injection valve body 27 in the form surrounding the intermediate portion 17 of the needle 2. The annular member 26 is also arranged, as viewed diametrically, between the needle 2 and the fuel injection valve body 27 in the form surrounding the intermediate portion 17 of the needle 2.

As can be understood from FIG. 1, as viewed along the longitudinal axis, the annular member 26 is arranged on the base end surface of the nozzle 1, the elastic member 25 on the annular member 26, and the transmission member 24 between the elastic member 25 and the surface of the needle 2 facing the forward end side. In the state shown in FIG. 1 (i.e. the state in which the fuel flow into the fuel injection port 10 is cut off by the needled 2), the transmission member 24 is pushed toward the forward end side by the needle 2, and therefore the elastic member 25 is compressed between the transmission member 24 and the annular member 26. In other words, under this condition, the elastic member 25 applies the force, through the transmission member 24, to the needle 2 to move in the direction away from the fuel injection port 10 (hereinafter referred to as "the valve opening direction").

Next, the fuel flow in the fuel injection valve will be explained. The fuel flows into the fuel injection valve from the opening 22 on the base end side of the balance rod 5. The fuel that has flowed into the space 18 of the balance rod 5 from the opening 22 flows into the pressure chamber 21 from the forward end-side opening 23 of the balance rod 5. The fuel that has flowed into the pressure chamber 21 flows into the space 12 of the needle 2, and through the paths 13 of the needle 2, flows into the nozzle chamber 20. The fuel that has flowed into the nozzle chamber 20 flows in the gap 19 and reaches the neighborhood of the forward end portion having the needle seat wall surface 14 (hereinafter referred to simply as "the forward end portion of the needle 2"). If the needle seat wall surface 14 comes off from the nozzle seat wall surface 9 in the process, the fuel that has reached the neighborhood of the forward end portion of the needle 2 flows between the needle seat wall surface 14 and the nozzle seat wall surface 9, and by circumventing the needle 2, reaches the forward end portion of the needle 2. Then, the fuel is injected from the fuel injection valve through the fuel injection port 10.

Next, the operation of the fuel injection valve will be briefly explained. According to this embodiment, once power is supplied to the solenoid 4, fuel is injected from the fuel injection valve. Specifically, when power is supplied to the solenoid 4, the electromagnetic force is generated from the solenoid 4. This electromagnetic force attracts the armature 3 toward the base end side. The armature 3 is mounted on the needle 2, and therefore, when the armature 3 is attracted toward the base end side, the needle 2 is also attracted toward the base end side. As a result, the needle seat wall surface 14 is separated from the nozzle seat wall surface 9. In this way, the fuel that has reached the neighborhood of the forward end portion of the needle 2 circumvents the needle and reaches the forward end portion of the needle 2. Then, the fuel is injected from the fuel injection port 10. When power supply to the solenoid 4 is stopped, on the other hand, the generation of the electromagnetic force from the solenoid 4 is stopped. Then, the needle 2 is moved toward the fuel injection port 10 at the forward end side mainly by the urging force of the coil spring 6, and finally, the needle wall surface 14 comes into contact with the nozzle seat wall surface 9. Thus, the fuel injection from the fuel injection port 10 is stopped.

Figure 8A:
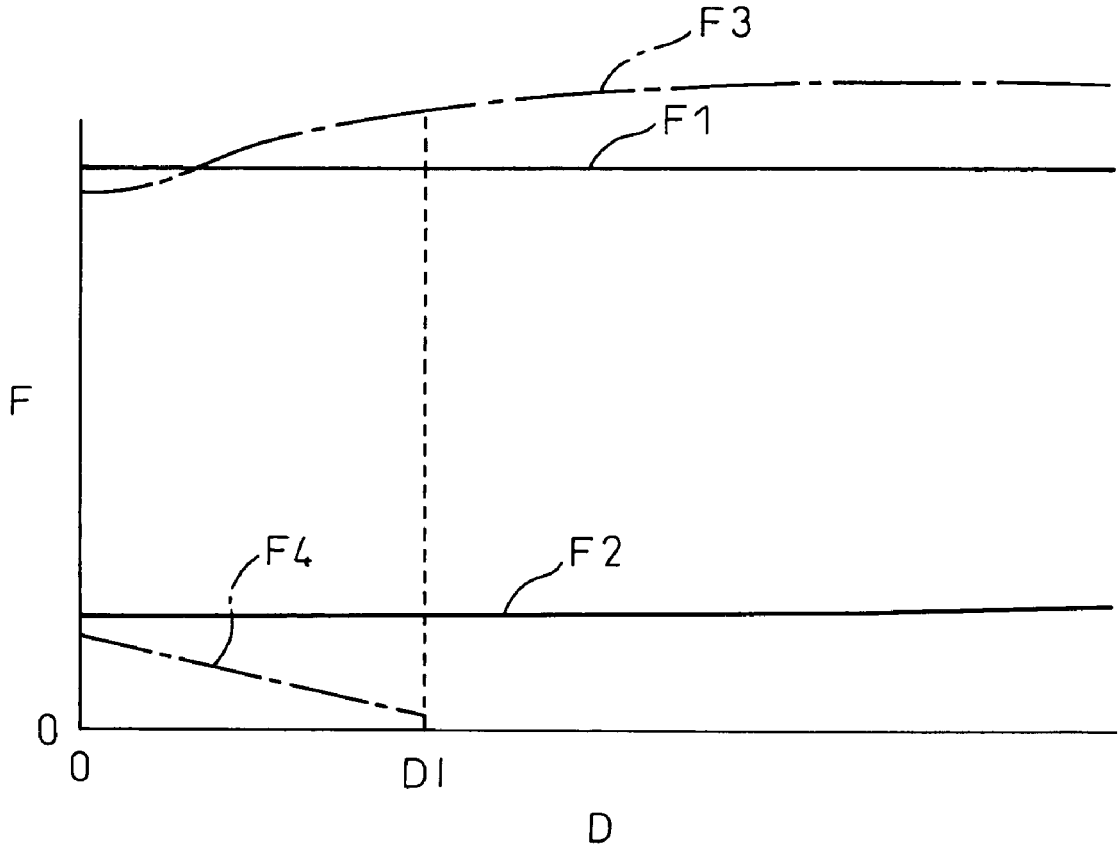
FIG. 8A is a diagram showing the relation between the needle lift amount D and the force F (F1 to F4) exerted on the needle.

Next, the operation of the fuel injection valve will be explained in detail. Reference is made to FIGS. 1 and 3. The forces working on the needle 2 in the valve closing direction (the direction in which the needle 2 is moved toward the fuel injection port 10) includes the force attributable to the fuel pressure (the average value of the pressure of the fuel supplied to the fuel injection valve) (hereinafter referred to as "the valve closing force due to the fuel pressure") and the force attributable to the coil spring (hereinafter referred to as "the valve closing force due to the coil spring"). More specifically, the valve closing force due to the fuel pressure is the force determined by multiplying the diameter of the space 11 (the diameter D1 in FIG. 3) by the fuel pressure, and the valve closing force due to the coil spring 6 is the urging force of the coil spring 6. The valve closing force due to the fuel pressure is substantially constant regardless of the lift amount of the needle 2 (which indicates the distance by which the needle seat wall surface 14 is off from the nozzle seat wall surface 9). The valve closing force due to the coil spring 6, on the other hand, though a little varied with the lift amount of the needle 2, is considered substantially constant regardless of the lift amount of the needle 2. FIG. 8A shows the relation between the lift amount D of the needle 2 and the force F acting on the needle 2. In FIG. 8A, the solid line F1 represents the valve closing force due to the fuel pressure, and the solid line F2 the valve closing force due to the coil spring 6.

The forces acting on the needle 2 in the valve opening direction (the direction in which the needle 2 is moved away from the fuel injection port 10) include the force attributable to the fuel pressure (hereinafter referred to as "the valve opening force due to the fuel pressure") and the force attributable to the elastic member 25 (hereinafter referred to as "the valve opening force due to the elastic member"). More specifically, the valve opening force due to the fuel pressure is the force determined by multiplying the difference between the outer diameter of the intermediate portion 17 (the diameter D2 in FIG. 3) and the diameter of the seat portion (the diameter D3 in FIG. 3) by the fuel pressure in the case where the needle seat wall surface 14 is in contact with the nozzle seat wall surface 9 (i.e. in the case where the fuel injection valve is closed). In the case where the needle seat wall surface 14 is separated from the nozzle seat wall surface 9 (i.e. in the case where the fuel injection valve is open), on the other hand, the valve opening force due to the fuel pressure is the force determined by multiplying the outer diameter D2 of the intermediate portion 17 by the fuel pressure. In FIG. 8A, the one-dot chain F3 represents the valve opening force due to the fuel pressure.

As can be understood also from FIG. 8A, the force, which is exerted on the nozzle seat wall surface 14 by the fuel that has reached the nozzle seat wall surface 14 nearer to the forward end side of the needle 2 than the seat portion after separation of the needle seat wall surface 14 from the nozzle seat wall surface 9 and the resultant flow of the fuel between the needle seat wall surface 14 and the nozzle seat wall surface 9, increases with the lift amount of the needle 2. The valve opening force due to the fuel pressure with the fuel injection valve open, therefore, increases with the lift amount of the needle 2. In other words, when the lift amount of the needle 2 is small, the fuel flowing between the needle wall surface 14 and the nozzle seat wall surface 9 is reduced, and therefore the valve opening force due to the fuel pressure increases with the lift amount of the needle 2.

Figure 9:
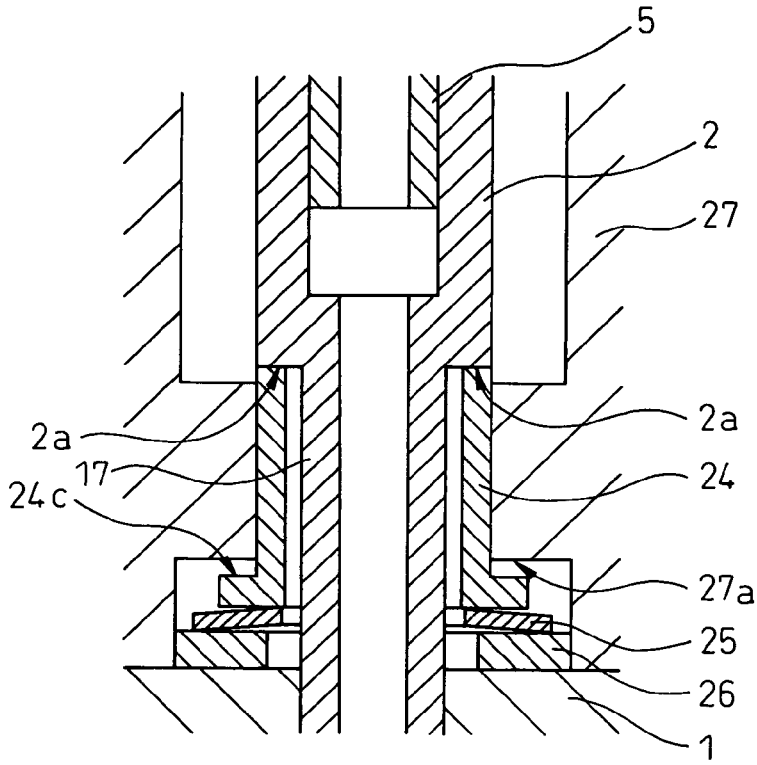
FIG. 9 is a longitudinal sectional view showing the component elements of the fuel injection valve of FIG. 1 in closed state.
Figure 10:
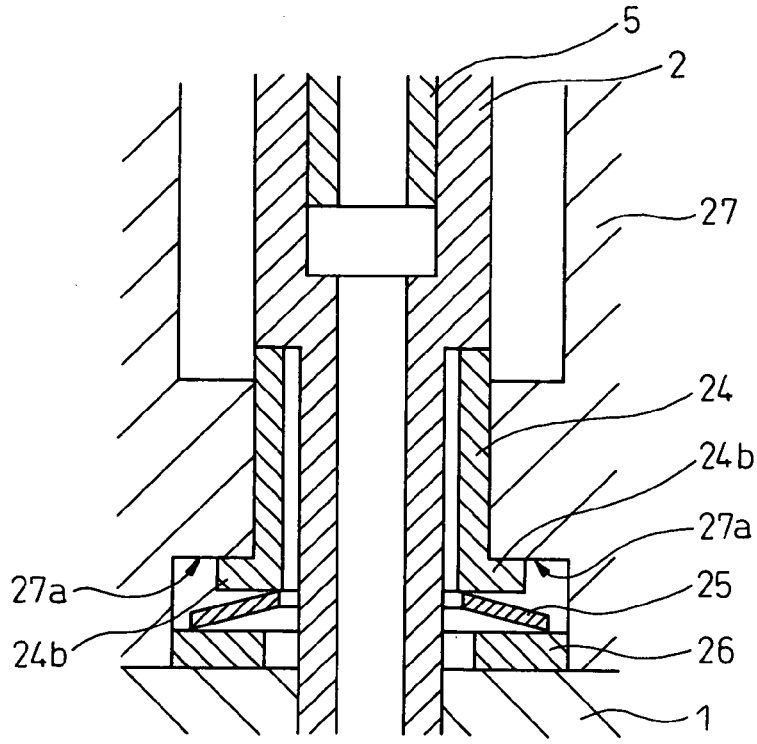
FIG. 10 is a longitudinal sectional view showing the component elements of the fuel injection valve of FIG. 1 in a first open state.
Figure 11:
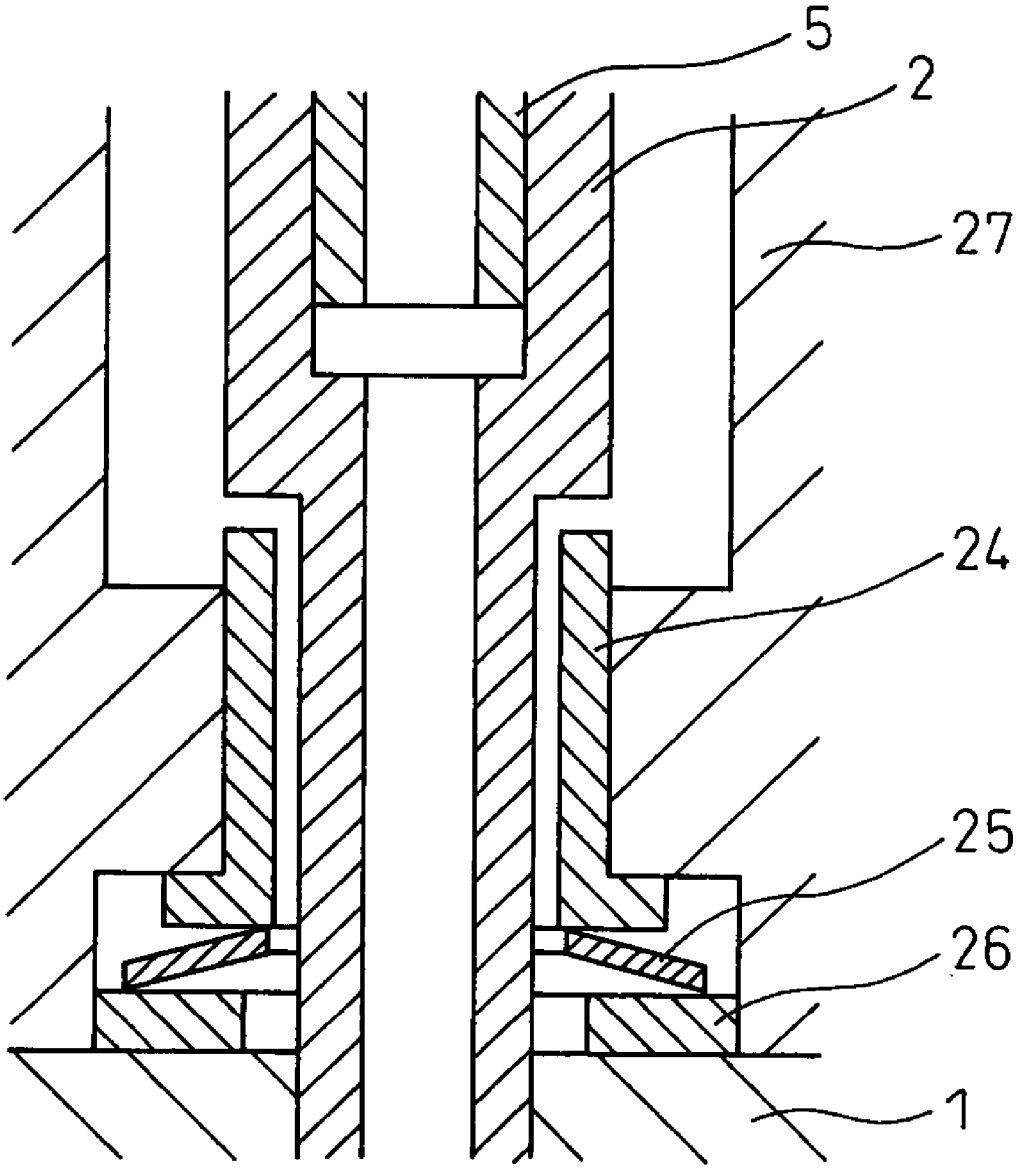
FIG. 11 is a longitudinal sectional view showing the component elements of the fuel injection valve of FIG. 1 in a second open state.

The valve opening force due to the elastic member 25 is the urging force of the elastic member 25. The valve opening force of the elastic member 25 is explained with reference to FIGS. 9 to 11. FIGS. 9 to 11 are enlarged views of the elastic member 25 and the surrounding parts thereof. In particular, FIG. 9 shows the state of the elastic member 25, etc. with the fuel injection valve closed. FIG. 10 shows the state of the elastic member 25, etc. with the fuel injection valve open to a predetermined degree (i.e. with the lift amount of the needle 2 assuming a predetermined value). Further, FIG. 11 shows the state of the elastic member 25, etc. with the fuel injection valve open to maximum (i.e. with the lift amount of the needle 2 assuming the maximum value).

In the state shown in FIG. 9, the transmission member 24 is pushed toward the forward end side by the end surface 2*a* facing the forward end of the needle 2. Thus, the elastic member 25 is also compressed by being pushed toward the forward end side. Therefore, the needle 2 is urged in the valve opening direction by the elastic member 25 through the transmission member 24. Under this condition, the elastic member 25 is compressed to the maximum.

With power supplied to the solenoid 4, the electromagnetic force for moving the armature 3 in the valve opening direction is generated by the solenoid 4, and therefore the force to move the needle 2 in the valve opening direction is exerted on the needle 2 through the armature 3. The electromagnetic force generated from the solenoid 4 is set at a sufficient value to open the needle 2, and therefore by supplying power to the solenoid 4, the fuel injection valve begins to open. At the same time, the needle 2 begins to move in the valve opening direction. For some time after the needle 2 begins to move in the valve opening direction, the elastic member 25 continues to apply the urging force in the valve opening direction to the needle 2 through the transmission member 24. With the increase in the lift amount, the urging force applied to the needle 2 by the elastic member 25 decreases steadily. Once the lift amount of the needle 2 reaches a predetermined value (D1 in FIGS. 8A and 8B), the flange portion 24*b* of the transmission member 24 comes into contact with the wall surface 27*a* facing the forward end side of the fuel injection valve. This state is shown in FIG. 10.

When the lift amount of the needle 2 exceeds the predetermined value, the transmission member 24 is separated from the needle 2, and therefore the elastic member 25 no longer applies the urging force in the valve opening direction to the needle 2. This state is shown in FIG. 11.

To summarize, the valve opening force due to the elastic member 25 decreases with the increase in the lift amount of the needle 2 until the lift amount of the needle 2 reaches a predetermined value (i.e. until the flange portion 24*b* of the transmission member 24 comes into contact with the wall surface 27*a* of the fuel injection valve body 27) from zero. After the lift amount of the needle 2 exceeds the same predetermined value (i.e. after the flange portion 24*b* of the transmission member 24 comes into contact with the wall surface 27*a* of the fuel injection valve body 27), the valve opening force becomes zero. In FIG. 8A, the one-dot chain F4 indicates the valve opening force due to the elastic member 25.

Figure 8B:
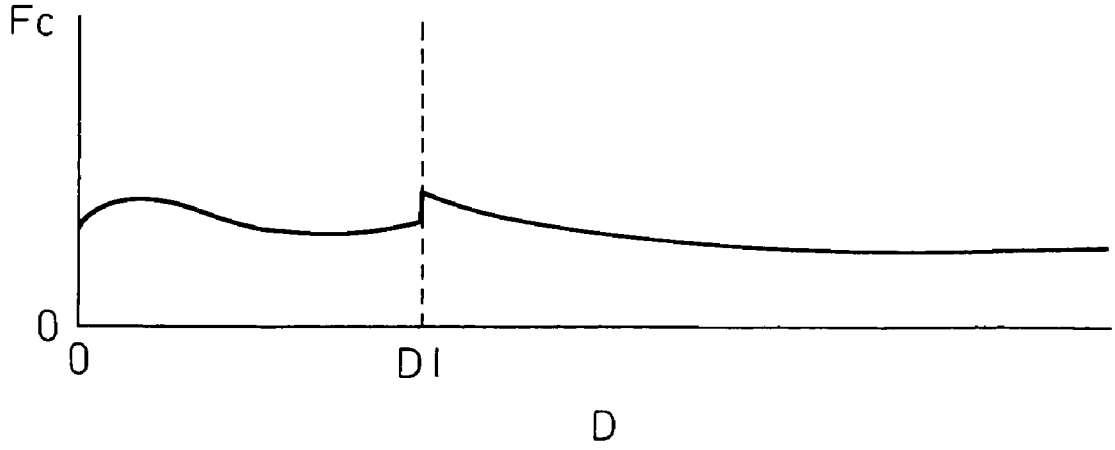
FIG. 8B is a diagram showing the relation between the needle lift amount D and the total valve closing force Fc exerted on the needle.

According to this embodiment, the valve opening force due to the elastic member 25 described above acts on the needle 2. The relation between the valve closing force Fc acting on the needle 2 and the lift amount D of the needle 2 is shown in FIG. 8B. Specifically, according to this embodiment, the total valve closing force Fc, though somewhat varied with the lift amount D of the needle 2, is substantially constant. The total valve closing force Fc with the lift amount D of the needle 2 at about zero is substantially equal to the total valve closing force Fc associated with a comparatively large lift amount D of the needle 2. In the case where power is supplied to the solenoid 4 in an attempt to open the fuel injection valve, therefore, the electromagnetic force to be generated by the solenoid 4 is comparatively small. Generally, a large-sized solenoid is required to generate a large electromagnetic force. According to this embodiment, in contrast, the solenoid is so compact that the fuel injection valve can be reduced in size. This improves the mountability of the fuel injection valve on the internal combustion engine. Also, with an increase in the solenoid size, the responsiveness thereof is generally reduced. According to this embodiment, a highly responsive solenoid can be employed, and therefore the operation response of the fuel injection valve is improved. With a small solenoid, only a very short time is required to cut off the valve opening force of the needle 2 after stopping power supply to the solenoid.

Figure 12:
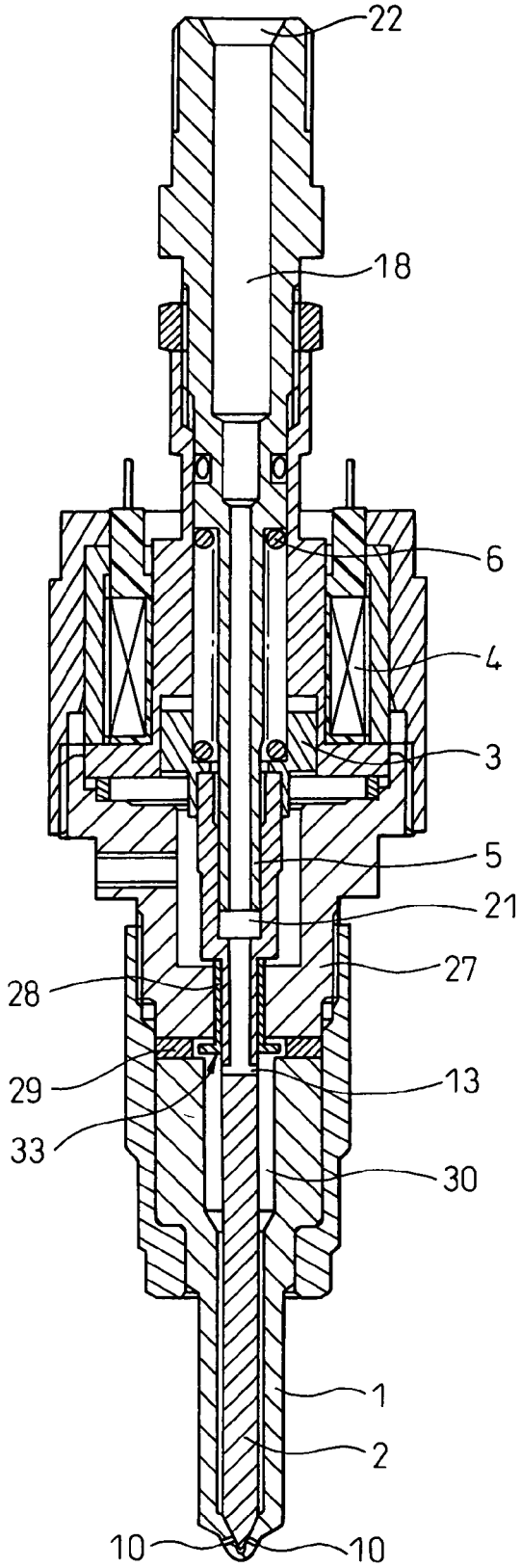
FIG. 12 is a longitudinal sectional view showing the fuel injection valve according to a second embodiment.

Next, a second embodiment of the invention will be explained. FIG. 12 shows a fuel injection valve according to the second embodiment. Also in FIG. 12, numeral 1 designates a nozzle, numeral 2 a needle, numeral 3 an armature, numeral 4 a solenoid, numeral 5 a balance rod and numeral 6 a coil spring.

Figure 13:
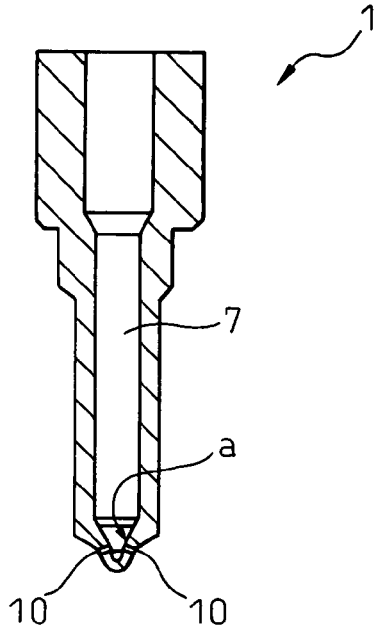
FIG. 13 is a longitudinal sectional view of the nozzle of the fuel injection valve shown in FIG. 12.
Figure 14:
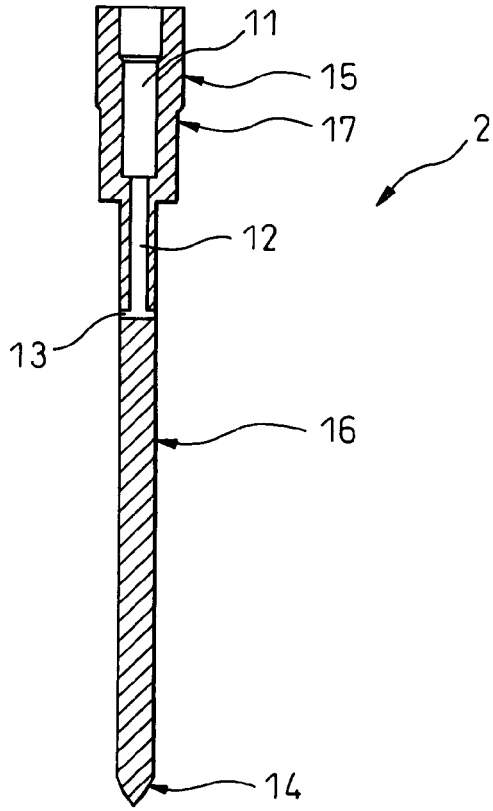
FIG. 14 is a longitudinal section view of the needle of the fuel injection valve shown in FIG. 12.

FIG. 13 shows the nozzle 1 according to the second embodiment. In FIG. 13, numeral 7 designates a space, numeral 9 a nozzle seat wall surface, and numeral 10 fuel injection ports. FIG. 14 shows the needle 2 according to the second embodiment. In FIG. 14, numerals 11, 12 designate a space, numeral 13 paths, numeral 14 a needle seat wall surface, numeral 15 a base end-side portion of the needle 2, numeral 16 a forward end-side portion of the needle 2 and numeral 17 an intermediate portion.

Figure 15:
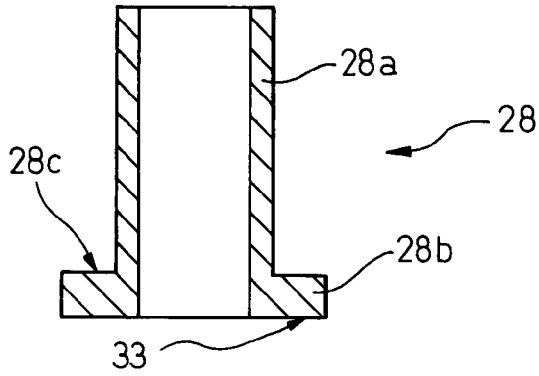
FIG. 15 is a longitudinal sectional view of a pressure receiving member of the fuel injection valve shown in FIG. 12.

Referring to FIG. 12, the fuel injection valve 1 according to the second embodiment, the transmission member 14, the elastic member 25 and the annular member 20 in the first embodiment are replaced with a substantially tubular member 28 and an annular spacer 29. The substantially tubular member 28 is for receiving the fuel pressure and transmitting it to the needle 2, and is hereinafter referred to as "the pressure receiving member". As shown in FIG. 15, the pressure receiving member 28 includes a tubular body 28*a*, and a flange portion 28*b* extending in the direction perpendicular to the center axis (longitudinal axis) of the body 28*a* from the lower outer wall surface of the body 28*a* away from the center axis of the body 28*a*. The pressure receiving member 28 accommodates the comparatively base end-side portion of the forward end-side portion 16 of the needle 2 and is arranged between the needle 2 and the fuel injection valve body 27 as viewed along the diameter. Also, no gap is formed between the inner peripheral surface of the pressure receiving member 28 and the outer peripheral surface of the needle 2, and the inner peripheral surface of the pressure receiving member 28 is in contact with the outer peripheral surface of the needle 2. The pressure receiving member 28, however, is slidable with respect to the needle 2. Also, no gap is formed between the outer peripheral surface of the pressure receiving member 28 and the inner peripheral surface of the fuel injection valve body 27, and the outer peripheral surface of the pressure receiving member 28 is in contact with the inner peripheral surface of the fuel injection valve body 27. The pressure receiving member 28 is adapted to slide with respect to the fuel injection valve body. Further, in the state shown in FIG. 12, as viewed from the direction of the longitudinal axis, a gap is formed between the wall surface of the pressure receiving member 28 facing the base end-side portion (specifically, the wall surface of the flange portion 28*b* facing the base end-side portion) 28*c* and the wall surface 27*a* of the fuel injection valve body 27 facing the forward end-side portion (FIG. 17).

Figure 17:
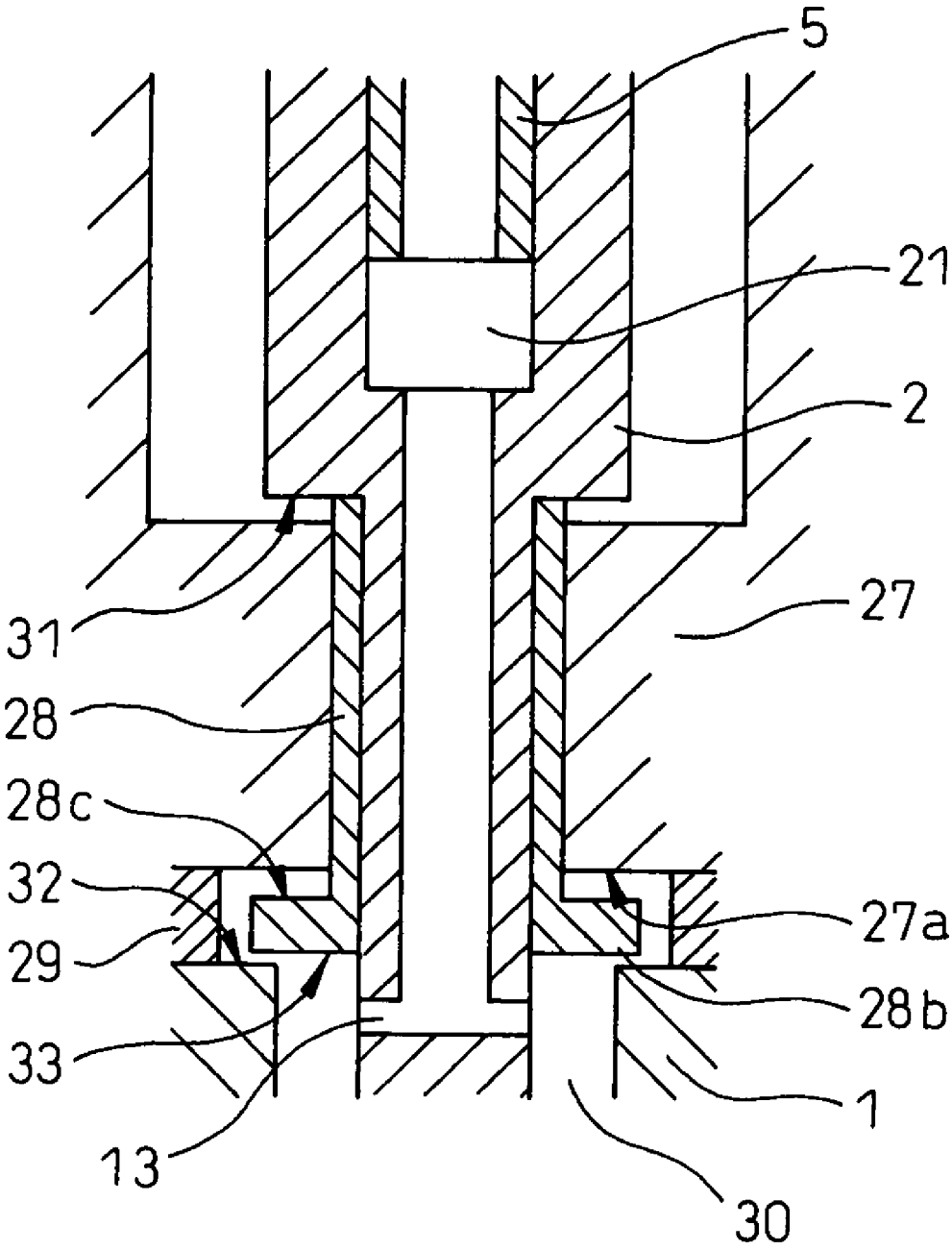
FIG. 17 is a longitudinal sectional view showing the component elements of the fuel injection valve of FIG. 12 in closed state.
Figure 18:
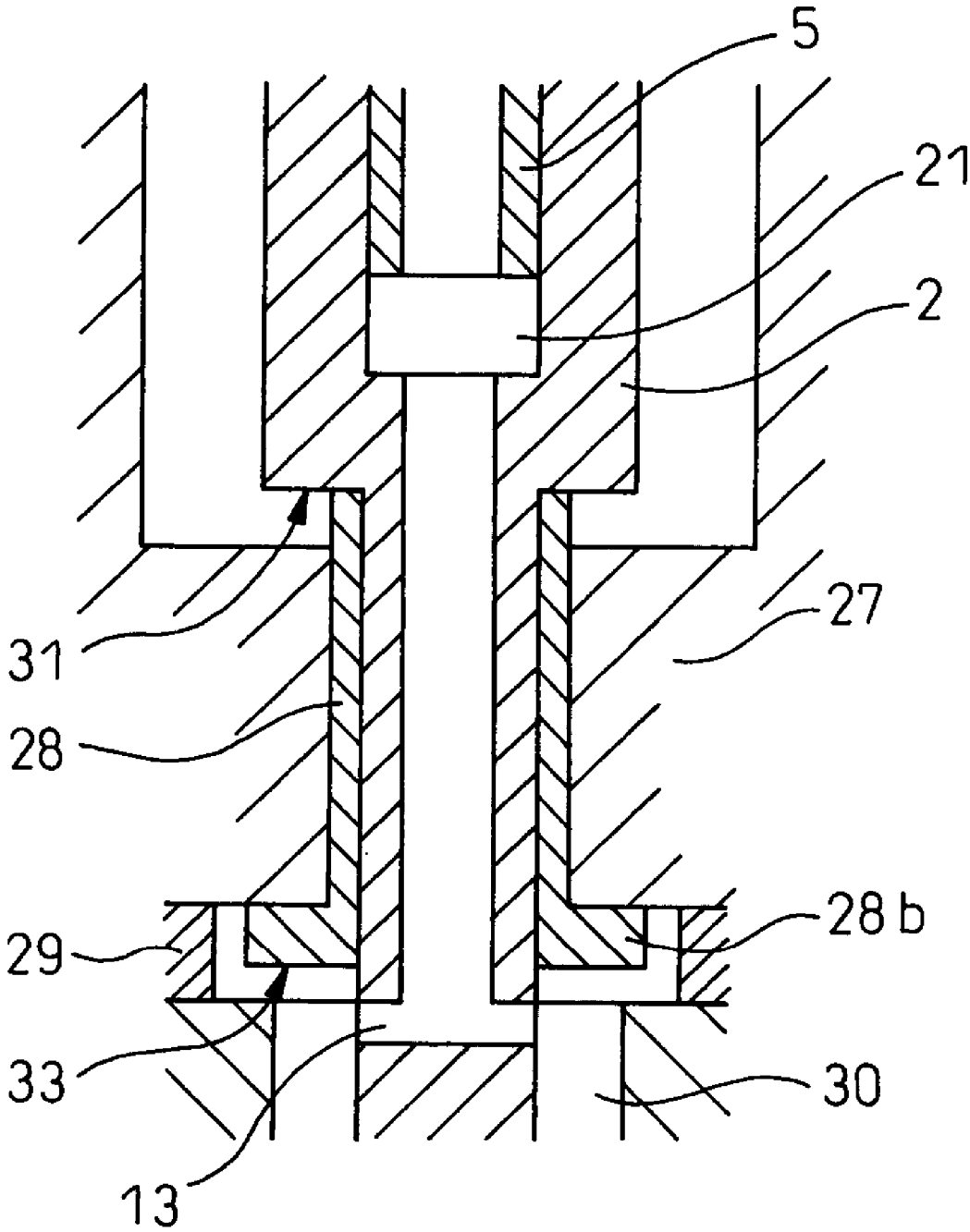
FIG. 18 is a longitudinal sectional view showing the component elements of the fuel injection valve of FIG. 12 in a first open state.
Figure 19:
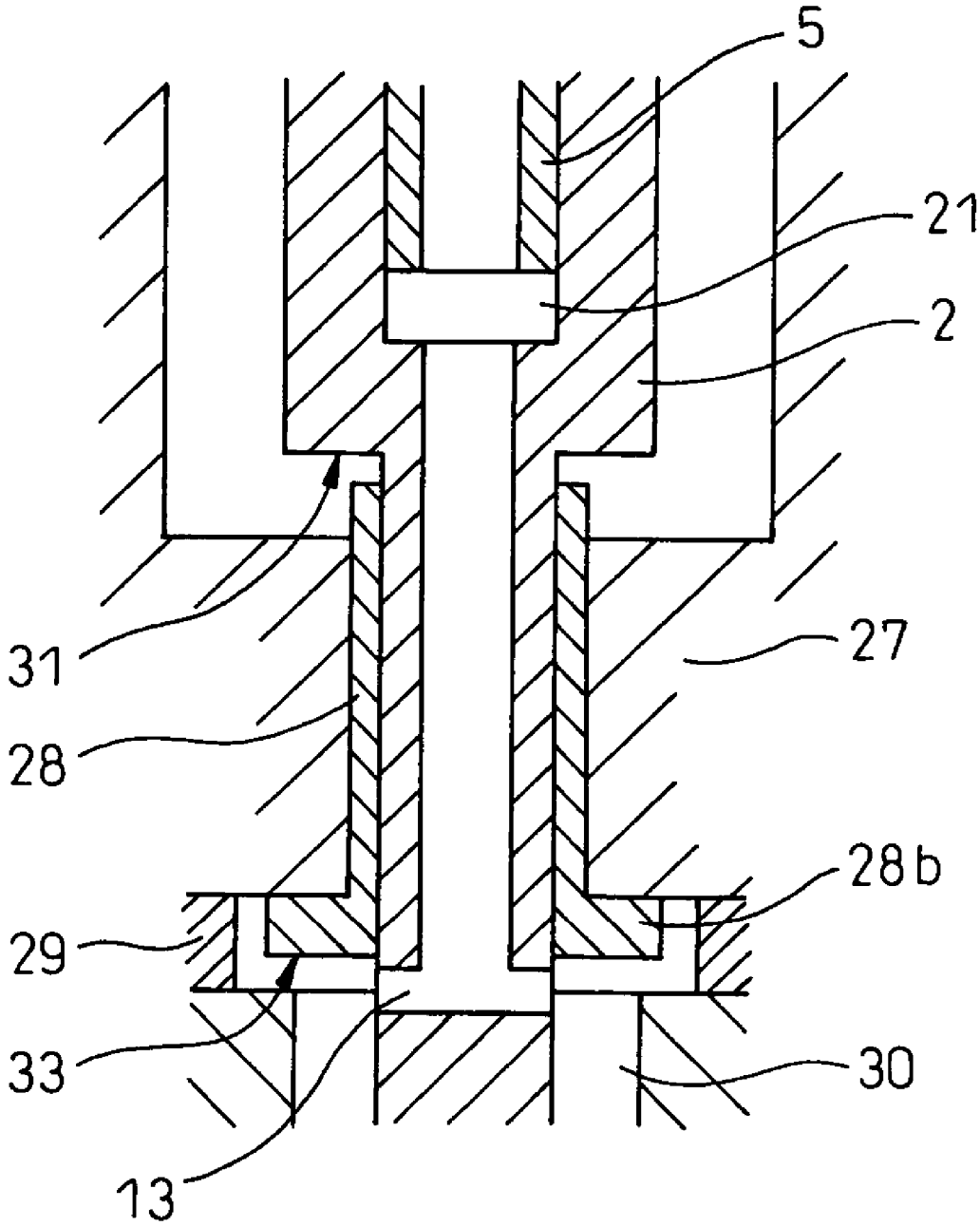
FIG. 19 is a longitudinal sectional view showing the component elements of the fuel injection valve of FIG. 12 in a second open state.

As viewed from the direction of the longitudinal axis, on the other hand, the pressure receiving member 28 is arranged between the end surface 31 of the needle 2 facing the forward end-side portion and the end surface 32 of the nozzle 1 facing the base end-side portion (see FIGS. 17 to 19 for more detail). In the state shown in FIG. 12, the pressure receiving member 28 is pressed against the end surface 31 facing the forward end-side portion of the needle 2 under the fuel pressure in the space 30 described later, and a gap is formed between the wall surface of the flange portion 28*b* facing the forward end-side portion and the end surface 32 of the nozzle 1 facing the base end-side portion.

The spacer 29 is arranged between the fuel injection valve body 27 and the nozzle 1.

A space 30 is defined between the outer peripheral surface of the needle 2 and the inner peripheral surface of the nozzle 1. The end surface 33 at the forward end side of the pressure receiving member 28 is exposed to the space 30. The fuel flows into the space 18 from the base end-side opening 22 of the balance rod 5, and flows out into the space 30 from the paths 13 of the needle 2 through the pressure chamber 21. Therefore, the fuel pressure is imposed in the valve opening direction on the end surface 33 at the forward end side of the pressure receiving member 28 exposed to the space 30. The fuel that has flowed out into the space 30 from the paths 13 of course reaches the neighborhood of the forward end portion. In the case where the needle seat wall surface 14 is separated from the nozzle seat wall surface 9, the fuel flows through the space between the needle seat wall surface 14 and the nozzle seat wall surface 9, by circumventing the needle 2, into the forward end portion of the needle 2, and is injected from the fuel injection valve through the fuel injection port 10.

Next, the operation of the fuel injection valve according to the second embodiment will be briefly explained. Also in this embodiment, once power is supplied to the solenoid 4, the armature 3 is attracted toward the base end side by the electromagnetic force generated by the solenoid 4. As a result, the needle 2 is also attracted toward the base end side, and the needle seat wall surface 14 comes off from the nozzle seat wall surface 9. In this way, the fuel that has reached the neighborhood of the forward end portion of the needle 2 reaches the forward end portion of the needle 2 by circumventing the needle 2, and is injected from the fuel injection port 10. Once power supply to the solenoid 4 is stopped, on the other hand, the electromagnetic force also ceases to be generated from the solenoid 4. Then, the needle 2 is moved toward the fuel injection port 10 at the forward end side mainly by the urging force of the coil spring 6, and, finally, the needle seat wall surface 14 comes into contact with the nozzle seal wall surface 9. Thus, the fuel ceases to be injected from the fuel injection port 10.

Figure 16A:
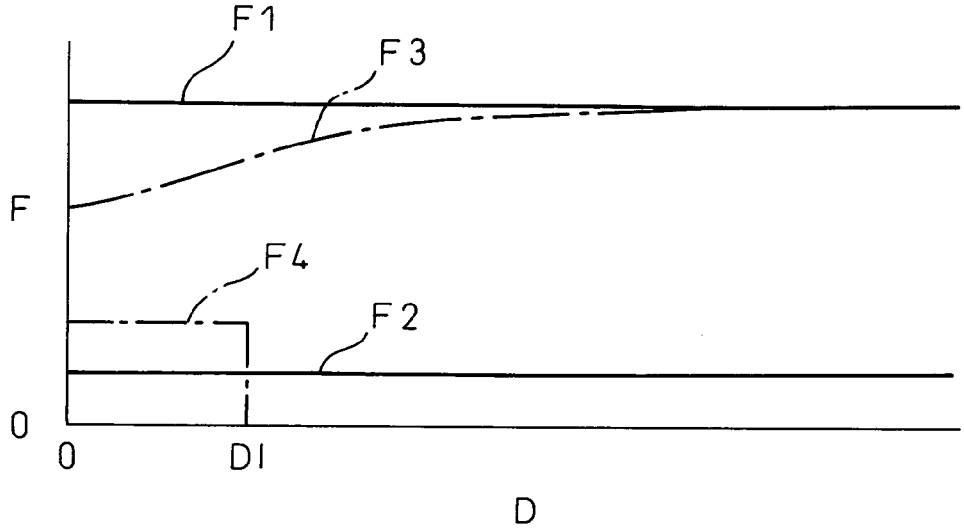
FIG. 16A is a diagram showing the relation between the needle lift amount D and the force F (F1 to F4) exerted on the needle.

Next, the operation of the fuel injection valve according to the second embodiment will be explained. As in the first embodiment, the needle 2 is subjected to the valve closing force due to the fuel pressure and the valve closing force due to the coil spring 6. FIG. 16A shows the relation between the lift amount D of the needle 2 and the force F acting on the needle 2. The solid line F1 represents the valve closing force due to the fuel pressure and the solid line F2 represents the valve closing force due to the coil spring 6. As can be understood from FIG. 16A, the valve closing force F1 due to the fuel pressure is substantially constant regardless of the lift amount D of the needle 2. The valve closing force due to the coil spring 6, on the other hand, though varied somewhat with the lift amount D of the needle 2, substantially remains constant regardless of the lift amount D of the needle 2.

The valve opening force due to the fuel pressure acts on the needle 2 like in the first embodiment. In FIG. 16A, the one-dot chain F3 represents the valve opening force due to the fuel pressure. According to the second embodiment, the needle 2 is subjected to the fuel pressure received from the fuel in the valve opening direction by the pressure receiving member 28 (hereinafter referred to as "the valve opening force from the pressure receiving member"). Next, the valve opening force from the pressure receiving member 28 is explained in detail with reference to FIGS. 17 to 19.

FIGS. 17 to 19 are enlarged views showing the pressure receiving member 28 and the neighboring parts. In particular, FIG. 17 shows the state of the pressure receiving member 28, etc. when the fuel injection valve is closed. FIG. 18 shows the state of the pressure receiving member 28, etc. when the fuel injection valve is open to a predetermined degree (i.e. when the lift amount of the needle 2 reaches a predetermined amount). Further, FIG. 19 shows the state of the pressure receiving member 28, etc. when the fuel injection valve is open to maximum (i.e. when the lift amount of the needle 2 reaches a maximum value).

In the state shown in FIG. 17, the fuel pressure acts on the pressure receiving member 28, and therefore the pressure receiving member 28 urges the needle 2 in the valve opening direction. When power is supplied to the solenoid 4 in this state, the needle 2 is moved in the valve opening direction, so that the fuel injection valve begins to open. For some time after the needle 2 begins to move in the valve opening direction, the fuel pressure acting on the pressure receiving member 28 continues to be transmitted to the needle 2. When the lift amount of the needle 2 reaches a predetermined value (D1 in FIGS. 16A and 16B), the flange portion 28*b* of the pressure receiving member 28 comes into contact with the wall surface 27*a* facing the forward end side of the fuel injection valve body. This state is shown in FIG. 18.

Once the lift amount of the needle 2 exceeds the predetermined value, the pressure receiving member 28 comes off from the needle 2 and, therefore, the fuel pressure is no longer applied to the needle 2 through the pressure receiving member 28. This state is shown in FIG. 19.

To summarize, the valve opening force from the pressure receiving member 28 continues to be applied to the needle 2 until the lift amount of the needle 2 reaches a predetermined amount from zero (i.e. until the flange portion 28*b* of the pressure receiving member 28 comes into contact with the wall surface 27*a* of the fuel injection valve body 27). After the lift amount of the needle 2 exceeds the predetermined value (i.e. after the flange portion 28 of the pressure receiving member 28 comes into contact with the wall surface 27*a* of the fuel injection valve body), however, the valve opening force from the pressure receiving member 28 is reduced to zero. In FIG. 16A, the one-dot chain F4 represents the valve opening force from the pressure receiving member 28.

Figure 16B:
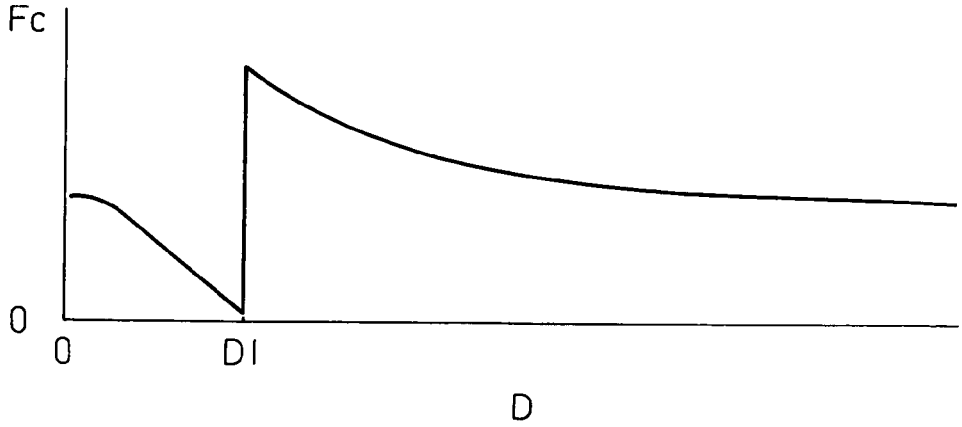
FIG. 16B is a diagram showing the relation between the needle lift amount D and the total valve closing force Fc exerted on the needle.

According to this embodiment, the valve opening force from the pressure receiving member 28 described above acts on the needle 2. The total valve opening force Fc acting on the needle 2 and the lift amount D of the needle 2 thus have the relation as shown in FIG. 16B. Specifically, according to this embodiment, the total valve closing force Fc remains substantially constant except when the lift amount D of the needle 2 assumes a value approximate to the predetermined value D1. When the lift amount D of the needle 2 is about zero, the total valve closing force Fc assumes value substantially equal to the total valve closing force Fc associated with a comparatively large lift amount D of the needle 2. When power is supplied to the solenoid 4 in an attempt to open the fuel injection valve, therefore, only a comparatively small electromagnetic force is required to be generated from the solenoid 4. As a result, as in the first embodiment, the fuel injection valve is reduced in size, and therefore the mountability of the fuel injection valve on the internal combustion engine is improved. The operation response of the fuel injection valve is also improved. The compact solenoid greatly shortens the time required from the time point when power stops being supplied to the solenoid to the time point when the valve opening force ceases to act on the needle 2.

While the invention has been described by reference to specific embodiments chosen for purposes of illustration, it should be apparent that numerous modifications could be made thereto by those skilled in the art without departing from the basic concept and scope of the invention.

The invention claimed is:

1. A fuel injection valve comprising:

a fuel injection port;

a needle for cutting off the fuel flowing into the fuel injection port;

a needle moving means for moving the needle in a direction away from the fuel injection port and thereby allowing the fuel to flow into the fuel injection port;

a force application means for applying a force to the needle in the direction away from the fuel injection port only during a period when the degree to which the needle has moved from the fuel injection port by the needle moving means is smaller than a predetermined degree; and a housing for accommodating the needle, wherein the needle, while cutting off the fuel flow into the fuel injection port, is in contact with an inner wall surface of the housing, and when the needle comes off from the inner wall surface of the housing, the fuel is allowed to flow into the fuel injection port, wherein when the needle comes off from the inner wall surface of the housing, the fuel circumvents the needle and flows to the neighborhood of the forward end of the needle through a space between the needle and the inner wall surface of the housing, wherein the predetermined degree corresponds to a point where the fuel flowing between the needle and the inner wall surface of the housing begins to be restricted when the needle comes off from the inner wall surface of the housing, and wherein the force application means comprises a transmission member that applies an urging force to the needle, and when the degree to which the needle has moved from the fuel injection port is smaller than the predetermined degree, the transmission member transmits the urging force to the needle, and when the degree to which the needle has moved from the fuel injection port is not smaller than the predetermined degree, a flange portion of the transmission member comes into contact with another wall surface formed on the housing so that movement of the transmission member is limited and the transmission member does not transmit the urging force to the needle.

2. A fuel injection valve according to claim 1, wherein the force application means includes an elastic member for generating the force to move the needle away from the fuel injection port, and wherein the force generated by the elastic member is applied to the needle until the needle moves away from the fuel injection port to the predetermined degree from the state in which the fuel flow into the fuel injection port is cut off by the needle, and the application of the force generated by the elastic member to the needle is cut off when the needle is moved at least to the predetermined degree away from the fuel injection port.

3. A fuel injection valve according to claim 1, wherein the force application means includes a pressure receiving member for receiving the force from the fuel in the direction away from the fuel injection port, and wherein the force received by the pressure receiving member from the fuel is applied to the needle until the needle moves away from the fuel injection port to the predetermined degree from the state in which the fuel flow into the fuel injection port is cut off by the needle, and the application of the force received by the pressure receiving member from the fuel to the needle is cut off when the needle is moved at least to the predetermined degree away from the fuel injection port.

* * * * *